US010396488B2

(12) United States Patent
Wölffle

(10) Patent No.: US 10,396,488 B2
(45) Date of Patent: Aug. 27, 2019

(54) SYSTEM CONSISTING OF A PLUG CONNECTOR MODULE FRAME AND ADAPTER ELEMENTS

(71) Applicant: Amphenol Tuchel Electronics GmbH, Heilbronn (DE)

(72) Inventor: Pascal Wölffle, Nordheim (DE)

(73) Assignee: Amphenol-Tuchel Electronics GmbH, Heilbronn (DE)

( * ) Notice: Subject to any disclaimer, the term of this patent is extended or adjusted under 35 U.S.C. 154(b) by 0 days.

(21) Appl. No.: 15/757,258

(22) PCT Filed: Aug. 25, 2016

(86) PCT No.: PCT/EP2016/070121

§ 371 (c)(1),
(2) Date: Mar. 2, 2018

(87) PCT Pub. No.: WO2017/036928

PCT Pub. Date: Mar. 9, 2017

(65) Prior Publication Data

US 2018/0248299 A1 Aug. 30, 2018

(30) Foreign Application Priority Data

Sep. 4, 2015 (DE) ..... 10 2015 114 814

(51) Int. Cl.
*H01R 13/648* (2006.01)
*H01R 13/518* (2006.01)
*H01R 13/514* (2006.01)

(52) U.S. Cl.
CPC ..... *H01R 13/518* (2013.01); *H01R 13/514* (2013.01)

(58) Field of Classification Search
CPC ..... H01R 23/725; H01R 23/7026; H01R 13/631; H01R 13/64; H01R 33/7628; H01R 23/005
USPC ..... 439/682, 567, 374, 680, 569, 941
See application file for complete search history.

(56) References Cited

U.S. PATENT DOCUMENTS 4,032,209 A * 6/1977 Rutkowski ..... H01R 9/26 439/211
6,773,271 B2 * 8/2004 Falchetti ..... H01H 85/2045 439/701
7,979,985 B2 * 7/2011 Spitaels ..... H01R 13/741 29/876

FOREIGN PATENT DOCUMENTS

| | | | |
|---|---|---|---|
| CN | 201656115 | U | 11/2010 |
| CN | 104769786 | A | 7/2015 |
| DE | 202012010735 | U1 | 12/2012 |
| DE | 202013103611 | U1 | 9/2013 |
| DE | 102013106279 | A1 | 12/2014 |
| GB | 2243729 | A | 11/1991 |

* cited by examiner

*Primary Examiner* — Phuong Chi T Nguyen
(74) *Attorney, Agent, or Firm* — Blank Rome LLP

(57) ABSTRACT

The invention relates to a system consisting of a plug connector module frame with a plurality of latching elements along two module frame side walls for fastening contact carrier modules, which have a mating latching geometry corresponding to the latching elements, and one or more adapter elements, for toolless fastening to the module frame side wall or walls, in order to fasten thereto contact carrier modules with a mating latching geometry which does not correspond to the latching elements, i.e. is different therefrom.

22 Claims, 3 Drawing Sheets

SYSTEM CONSISTING OF A PLUG CONNECTOR MODULE FRAME AND ADAPTER ELEMENTS

RELATED APPLICATIONS

This application is a national stage application of International Application No. PCT/EP2016/070121, filed Aug. 25, 2016, which is related to and claims priority to German Patent Application No. 10 2015 114 814.5, filed Sep. 4, 2015, the entire disclosures of which are hereby incorporated by reference.

The invention relates to a modular plug connector and also to a plug connector module frame for use with a modular plug connector.

Modular plug connectors are known, for example, from DE 81 11 418 U1 and EP 0 097 255 B1.

The plug connector according to EP 0 097 255 B1 is plugged onto a carrier body to which a conductor connection block which consists of disk-like insulating segments which are lined up with one another is fastened in turn. The insulating elements have recesses into which associated contact elements can be inserted.

In order to allow accessibility to the contact elements even in the inserted state, it is further provided that chamber-like opening are provided in the insulating body, a pin-like extension of the end regions of the contact elements protruding into said chamber-like opening. The insulating bodies have, on the top side, a recess into which a spacer bolt which is screwed to a frame part on the outside is inserted—transverse to the insulating segments. The segments are positioned in relation to one another by virtue of being screw-connected.

In the known embodiment, the number, the position and the assignment of the individual insulating bodies is specifically prescribed. For the purpose of replacement, the spacer bolts have to be loosened, the frame removed and the contact bodies separated from the carrier body before a new configuration can be provided.

DE 38 34 651 A1 discloses socket contacts which are retained in a modular manner. Here, the support bodies on the frame longitudinal parts are embodied as beveled strips which results in a weakening of the frame. An extremely wide variety of designs of plug connectors are known. Since the housings and the frames of plug-in connectors of this type are standardized in many cases (for example in the standard DIN 43 652), but on the other hand there is a great demand for customer-specific or application-orientated contact configurations, it is desirable to provide plug connectors which can be equipped with contact carriers which can be freely configured.

DE 87 17 110 U1 discloses a plug connection in which a frame comprising two parts is provided and contact modules of various designs can be inserted into said frame. The frame consists of two separated frame parts, one of said frame parts having on each longitudinal side a guide rail with a stop edge. The contact modules each have laterally corresponding webs so that they cannot fall through the frame part in their inserted state. The second frame part is mounted on the first frame part, in which the contact modules are located, and screwed-connected to said first frame part. The second frame part also has lateral webs which engage in corresponding recesses on the top side of the contact carriers so that said contact carriers are held in a captive manner in the screwed-connected frame. This solution is problematic insofar as assembly is relatively complex and subsequently any maintenance work which is necessary can be carried out only with difficulty. Furthermore, the two-part frame is relatively complex to produce and is therefore expensive.

DE 31 42 182 C2 discloses a plug connection having exchangeable plug inserts for various plug elements for receiving circuit boards with standardized male strip connectors, in this case a female strip connector is formed from a one-piece frame and segments of various forms, wherein the inner longitudinal sides of the frame are formed on one the one side as rectangular grooves and on the opposite side as prismatic webs, wherein the longitudinal sides of the frame are provided with various apertures for positively interlocking the segments by means of latching lugs.

It is further known from document EP 0 202 916 A2 to form the latching plate with a handle which protrudes beyond the end face of the contact carrier.

Document DE 93 01 220 U1 discloses a multipole plug apparatus which has a plastic main body with contact springs which are provided with contact blades which are assigned to said contact springs. In this case, the contact blades are arranged in a plurality of open chambers of a plug connection part and the contact springs which are arranged in the plastic main body are connected to connection elements by means of flexible cables with connection contacts.

The contact springs which are assigned to the contact blades of the chambers are arranged in a plurality of plastic bodies which are of block-like design and can be connected to one another and the plastic main body has cutouts which are provided with latching means and into which the plastic bodies which are assigned to the chamber can latch in a releasable manner. Therefore, the cutout in the plastic main body, which cutout is assigned to the chamber, can be individually equipped with plastic bodies, the contact springs of which are connected to connection elements by means of flexible cables.

DE 1 590 072 A1 discloses an electrical connector housing assembly having an insulating plate, wherein electrical connectors are fastened to the plate. The plate has a rectangular aperture into which a plurality of rectangular connector housings can be inserted. Laterally projecting webs are provided for this purpose on both sides of a first pair of sides that are arranged opposite one another, it being possible for said web to form a releasable connection with the plate.

One disadvantage of the modular plug connectors known from the prior art is that different plug connector manufacturers also offer different contact carrier modules. However, since each manufacturer has adapted the contact carrier modules to their module frame in respect of latching geometry and shape, it is rarely possible for a user to be able to fit modules from one manufacturer and modules from another manufacturer in one plug connector module frame. However, this means a large range of components for the user in industry and a high degree of stockpiling since the user has to make a decision in favor of one or the other variant depending on the application.

The prior art has the further advantage that once a user has made a decision in favor of a specific modular plug connector system, he cannot employ contact carrier modules from another manufacturer in the event of subsequent modifications, repairs or servicing measures, even though these may in some cases be virtually identical in respect of grid pattern, in respect of size and also in respect of technical conditions but differ in respect of specific latching geometries and other details.

The present invention is accordingly based on the object of providing a versatile solution in which a user can insert and use different contact carrier modules, that is to say contact carrier modules with different latching geometries, for the same modular plug connector.

A further object is that of being able to fit the contact carrier modules in the module plug connector as far as possible without problems and such that they can be released again.

This object is achieved by a plug connector module frame having the features of patent claim 1, and also by a modular plug connector having the features of patent claim 15.

The basic idea of the present invention is to provide a system in which a plug connector module frame of specific design is developed such that specific adapter elements can be secured to the module frame, it being possible for contact carrier modules which have a mating latching geometry which is not provided by the module frame to be fitted into said adapter elements.

Therefore, the plug connector module frame according to the invention can be used firstly for a basic structural shape of a contact carrier module which can be fitted without an adapter element, and further contact carrier modules, which differ therefore, can be fastened in the plug connector module frame after the adapter element of specific design can be fastened to or can be latched into holder sections, which are provided for this purpose, on the contact carrier module.

Therefore, the invention provides a system comprising a plug connector module frame having a plurality of latching elements along two module frame side walls for the purpose of fastening contact carrier modules, which have a mating latching geometry which corresponds to the latching elements, and comprising one or more adapter elements for being fastened to the module frame side wall or walls without using a tool, in order to fasten in said module frame side wall or walls contact carrier modules with a mating latching geometry which does not correspond to the latching elements.

This means that the further contact carrier modules have a mating latching geometry which differs from the latching geometry of the abovementioned contact carrier modules, that is to say a different mating latching geometry.

In one preferred embodiment of the invention, it is therefore provided that the plug connector module frame has as a module frame with two module frame side walls which are arranged in the longitudinal direction and two module frame side walls which connect first said module frame side walls and are oriented in the transverse direction in relation thereto.

Accordingly, contact carrier modules which are accordingly adapted in respect of their geometric width and length in particular, can be inserted into said module frames.

In a further advantageous embodiment of the invention, it is provided that the latching elements are in the form of lugs which project out of the longitudinally running module frame side walls and are preferably arranged in a specific or defined grid pattern. This ensures that the contact carrier modules of a special width can be arranged next to one another in a fixed mounting grid pattern in the module frame.

It is further advantageous when webs, which preferably extend upward, are respectively arranged on the module frame side walls adjacent to or between the lugs in such a way that they form a lateral stop for the adapter elements as soon as said adapter elements are fastened to the module frame side walls in the intended manner.

It is further preferred when the abovementioned webs further constitute or form lateral stops for at least one structural shape of the contact carrier modules.

It is further advantageously provided that holding elements for the purpose of fastening the abovementioned adapter elements are respectively provided on the module frame side walls which run in the longitudinal direction.

In a preferred type of assembly, the adapter elements are pushed onto the respective holding elements and moved to their final assembly position in a manner such that they can slide on the module frame side walls.

It is therefore advantageously provided when the holding elements on the module frame side walls are each formed with an undercut for the purpose of inserting corresponding adapter-side holding sections. In this way, the adapter elements can be to their assembly position "in the manner of a drawers", wherein the adapter-side holding sections engage behind the undercut of the module frame-side holding elements.

In a further advantageous embodiment of the present invention, it is provided that the adapter elements comprise a web which is adjoined in an integral manner by a frame part with a window-like opening.

According to the invention, different adapter elements can be provided, said adapter elements each being matched to the corresponding shape of the mating latching elements of further contact carrier modules. The geometric shape can also be matched to the different dimensions and tolerances of the contact carrier modules which are correspondingly to be fitted.

According to the invention, it is further advantageously provided when the adapter elements have holding sections which project laterally from the web and are preferably formed with a triangular cross section, so that they form a ramp-like section.

In the same way, it is preferred when the holding elements on the module frame side walls are likewise formed with an undercut of triangular cross section, so that the ramp-like sections of the adapter-side holding elements, as sliding surfaces, interact with the accordingly corresponding side walls of the holding elements on the module frame side walls.

It is further advantageously provided that the opening in the frame part of the adapter elements is in the form of a T-shaped opening in each case.

In a further advantageous embodiment of the present invention, it is provided that when one or the adapter elements is in the mounted state, the respective web bears against one of the module frame side walls, whereas the frame part projects at least partially beyond the top side of the module frame side wall in this section in such a way that the window-like opening likewise projects beyond said module frame side wall or the top side thereof, so that a passage for a corresponding mating latching means of a contact carrier module is formed.

It is further advantageously provided when, when an adapter element is in the mounted state, a latching element respectively protrudes into or through a portion of the opening in the adapter element, wherein another portion of said opening remains open, so that, as explained above, a mating latching geometry of a contact carrier module can pass through the remaining portion of the opening for the purpose of fastening said contact carrier module.

It is further provided according to the invention that the system is formed with at least one first contact carrier module with a mating latching geometry which corresponds to the latching elements is formed in the module frame, and also with at least one second contact carrier module which is fastened by way of its mating latching elements to two adapter elements which are situated diametrically opposite one another.

Furthermore, further first or second contact carrier modules can be provided in the system or fitted in the module frame in principle.

According to the invention, it is further provided, in one advantageous embodiment, that a first and second lateral mating latching geometry are in each case formed on said first contact carrier module, which mating latching geometries are in each case formed from two spring arms which are connected to one another and between which there is a gap for engagement with the module frame-side latching elements in each case. In other words, this means that there is a substantially U-shaped arm, formed from said two spring arms, which can be pushed over the module frame side wall and can be fastened to the module frame-side latching elements.

It is further provided according to the invention when a first and second lateral latching geometry is formed on the second contact carrier module which projects out of the respective side wall of the second contact carrier module as a projection.

A further aspect of the present invention relates to a modular plug connector comprising a plurality of identical and/or different contact carrier modules and also a plug connector module frame as described above.

Further refinements of the invention can be gathered from the dependent claims. The invention will be explained in more detail below with reference to an exemplary embodiment and the following figures, in which:

The invention will be explained in more detail below with reference to FIG. 1 to FIG. 5 using an exemplary embodiment. Identical reference symbols have the same functional and/or structural features.

Figure 1:
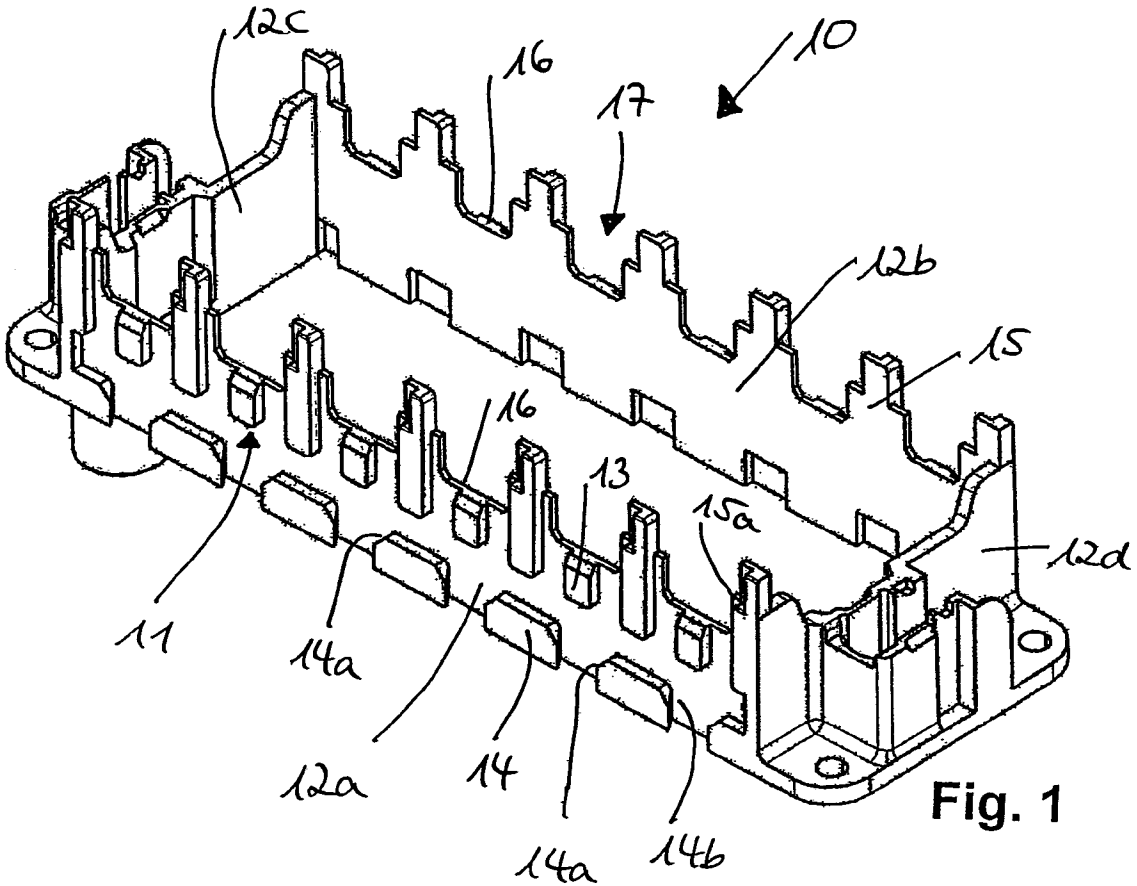
FIG. 1 shows a perspective view of an exemplary embodiment of a plug connector module frame.

FIG. 1 shows a perspective view of an exemplary embodiment of a module frame 10 according to the invention. The module frame 10 comprises two module frame side walls 12*a*, 12*b* which are oriented in the longitudinal direction and run substantially in parallel and also two module frame side walls 12*c*, 12*d* which likewise run in parallel and connect said two module frame side walls 12*a*, 12*b*.

In the present exemplary embodiment, the plug connector module frame 10 is a module frame which is formed from the four abovementioned module frame side walls 12*a*, 12*b*, 12*c*, 12*d*. Latching elements 11 are located on the module frame side walls, in a manner arranged on the outside in the present example. In the present exemplary embodiment, the latching elements 11 project in the form of lugs 13 from the module frame side walls 12*a*, 12*b*, in each case laterally in a fixed grid pattern. The lugs 13 are each located at apertures 17 in the module frame side walls 12*a*, 12*b*, specifically immediately below the top side 16 of the module frame side walls 12*a*, 12*b* in these sections.

Figure 4:
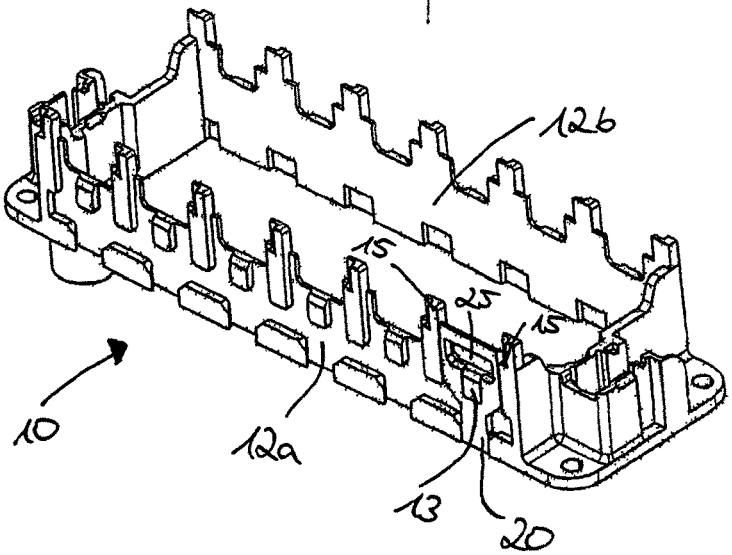
FIG. 4 shows a perspective view similar to FIG. 3, in which the adapter element is fully mounted.
Figure 5:
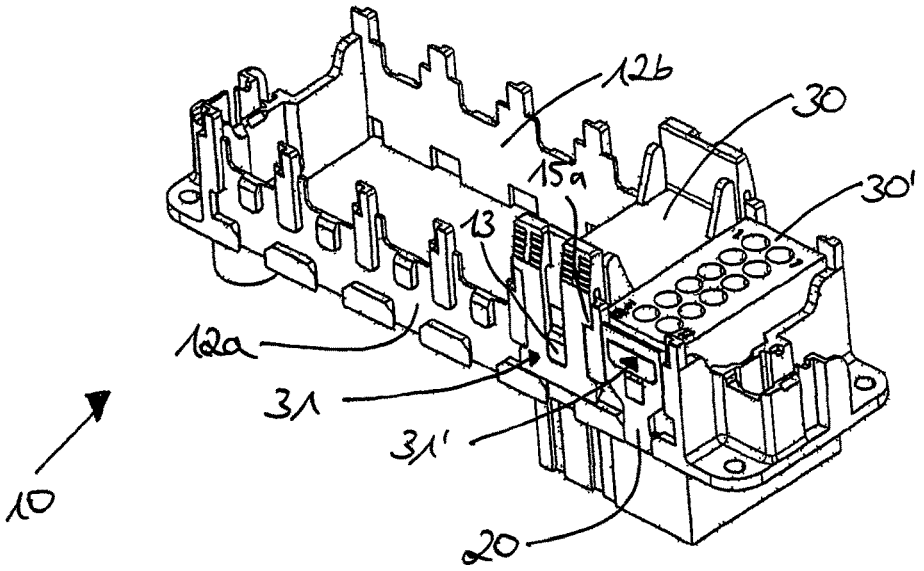
FIG. 5 shows a perspective view of the plug connector module frame according to FIG. 1 with two contact carrier modules with different latching geometries, which contact carrier modules are mounted in the plug connector module frame.

Furthermore, webs 15 which project beyond the top side 16 of the longitudinally running module frame side walls 12*a*, 12*b* and have shoulders 15*a* which are in the form of a lateral support for the adapter elements 20 (see FIG. 2 to FIG. 5) and also in the form of a lateral support for the mating latching geometry 31 of the contact carrier modules 30, as is shown in FIG. 5, are provided.

Figure 6:
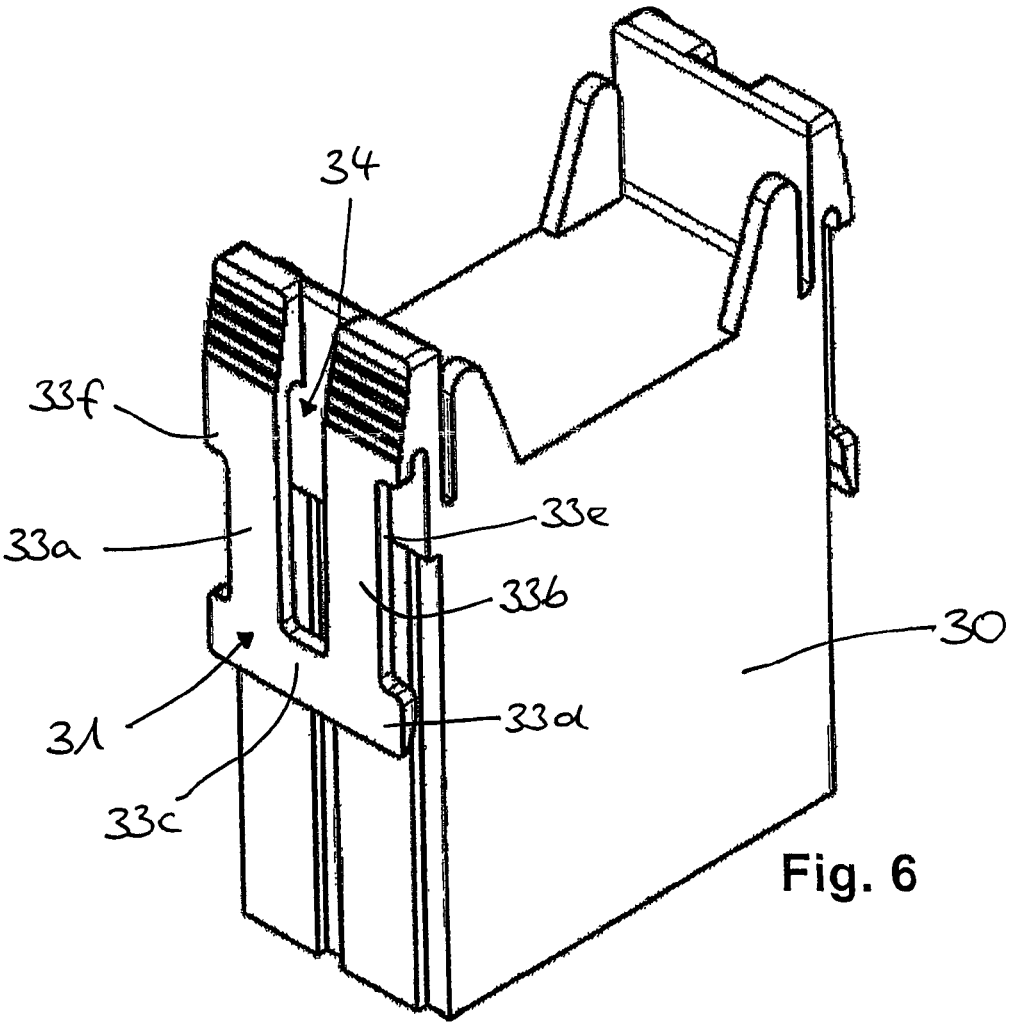
FIG. 6 shows a perspective view of a first contact carrier module.

An exemplary first contact carrier module 30 which can be fitted into the plug connector module frame 10 without using an adapter element 20 is shown in FIG. 6. The illustrated contact carrier module 30 has receptacles (not illustrated) for electrical contacts. A mating latching geometry 31 is formed laterally on the contact carrier module 30 in order to fasten the contact carrier module 30 to the plug connector module frame 10. In the present exemplary embodiment, the mating latching geometry 31 is formed from two spring arms 33*a*, 33*b* which are connected to one another at the end side by means of a transversely running section 33*c*, so as to form a gap 34 between them. The above-described lug 13 can enter the gap 34, in order to secure the contact carrier module 30 in its mounting position.

Furthermore, as shown in FIG. 5, the above-described shoulder 15*a* of the web 15 is in the form of a support for an edge of the mating latching geometry 31 of the contact carrier module 30 in the mounted position. In this respect, a lateral extension 33*d* of the mating latching geometry 31 engages beneath the bottom side of the web 15, whereas side edges 33*e* bear laterally against the web 15, and also a projection 33*f* of the mating latching geometry 31 enters the respective shoulder 15*a* of the web 15.

The interaction between the above-described contact areas, projections and latching elements which, together, form the latching geometry and mating latching geometry between the plug connector module frame 10 and the contact carrier module 30 ensures a secure fixed fit of the contact carrier module in the plug connector module frame 10.

Figure 2:
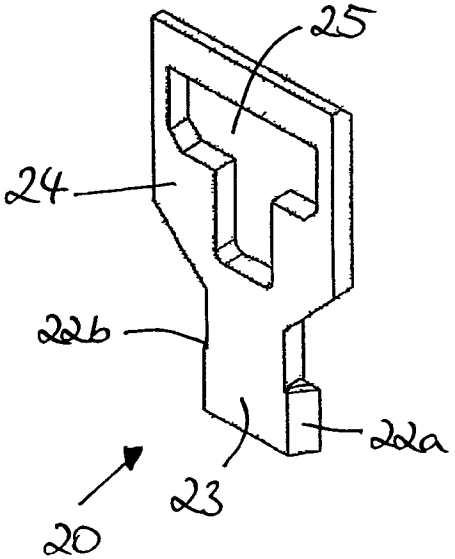
FIG. 2 shows a perspective view of an adapter element according to the invention.

The adapter element 20 according to the invention which is shown in FIG. 2 is used in order to fasten a contact carrier module 30' with a differing mating latching geometry 31' in the above-described plug connector module frame 10.

The adapter element 20 has a web 23 which is laterally adjoined by holding sections 22*a*, 22*b* which are each formed with a triangular cross section. A frame part 24 which has a window-like opening 25, which is T-shaped in the present exemplary embodiment, is integrally formed on the web 23.

In the mounted state, the adapter-side holding sections 22*a*, 22*b* engage behind the undercuts 14*a*, 14*b* in the holding elements 14.

Figure 3:
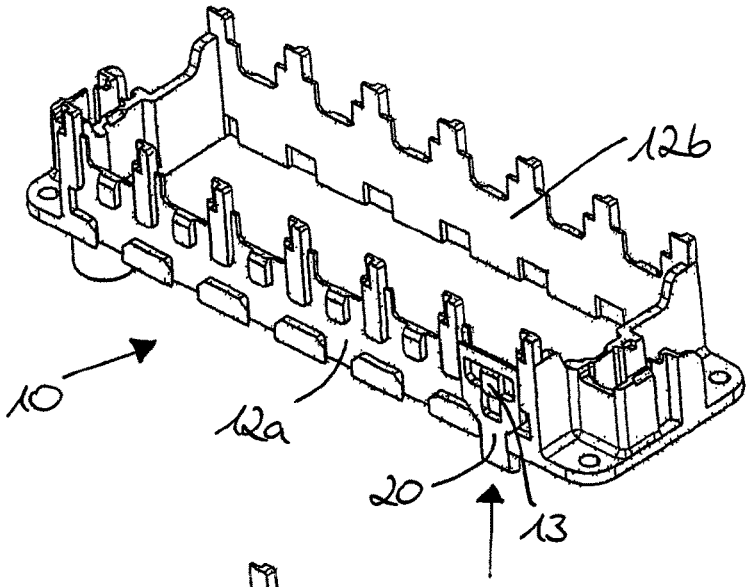
FIG. 3 shows an intermediate mounting state, in which the adapter element from FIG. 2 is fastened to the module frame of FIG. 1.

The assembly is described in more detail in FIG. 2 and FIG. 3. An adapter element 20 can be inserted in the manner of a drawer from below by way of its adapter-side holding sections 22*a*, 22*b* behind the undercuts 14*a*, 14*b* of respectively adjacent holding elements 14.

In FIG. 4, the adapter element is in its fully inserted state in which the above-described latching element 11, that is to say the lug 13, protrudes through the lower portion of the T-shaped opening 25 and therefore secures the adapter element in its end position such that it is prevented from shifting upward. In this position, the holding sections 22*a*, 22*b* of the adapter element 20 engage behind the above-mentioned undercuts 14*a*, 14*b* of the holding elements 14. In this case, a partial opening, as shown in FIG. 4, of the window-like opening 25 remains, so that the corresponding mating latching elements 31' of the contact carrier module 30' can be fitted in accordance with FIG. 5. In the mounted state, the mating latching elements 31' pass through the remaining portion of the window-like opening 25 and the contact carrier module 30' is fixedly held in the plug connector module frame 10.

The invention is not restricted to the exemplary embodiment described in the present case, but rather can also be further defined by combining different described features. Therefore, in particular, geometric adaptations can be made in respect of receiving other further contact carrier modules 30, 30'.

List of reference symbols

| | |
|---|---|
| 10 | Plug connector module frame |
| 11 | Latching element |
| 12a, 12b, 12c, 12d | Module frame side wall |
| 13 | Lug |
| 14 | Holding element |
| 14a, 14b | Undercut |
| 15 | Web |
| 15a | Shoulder |
| 16 | Top side |
| 17 | Aperture |
| 20 | Adapter element |
| 22a, 22b | Holding section |
| 23 | Web |
| 24 | Frame part |
| 25 | Opening |
| 30 | Contact carrier module |
| 30' | Contact carrier module |
| 31 | Mating latching geometry |
| 31' | Mating latching geometry |
| 33a, 33b | Spring arm |
| 33c | Section |
| 33d | Extension |
| 33e | Side edge |
| 33f | Projection |
| 34 | Gap |

The invention claimed is:

1. A system comprising a plug connector module frame having a plurality of latching elements along module frame side walls for fastening first contact carrier modules thereto, each of the first contact carrier modules has a mating latching geometry which corresponds to the latching elements, and one or more adapter elements configured to be fastened to one of the module frame side walls without using a tool, in order to fasten to said module frame side walls, second contact carrier modules with a latching geometry which is different from the latching elements, wherein holding elements for fastening the adapter elements are respectively provided on the module frame side walls which run in the longitudinal direction.

2. The system as claimed in claim 1, characterized in that two of the module frame side walls are arranged in the longitudinal direction and another two module frame side walls connect to said two of the module frame side walls and are oriented in the transverse direction in relation thereto.

3. The system as claimed in claim 1, characterized in that the latching elements are in the form of lugs which project out of the longitudinally running module frame side walls and are arranged in a defined grid pattern.

4. The system as claimed in claim 3, characterized in that webs are respectively arranged adjacent to or between the lugs in such a way that they form a lateral stop for the adapter elements when said adapter elements are fastened to the module frame side walls.

5. The system as claimed in claim 4, characterized in that the retaining elements are each formed with an undercut on a side thereof for inserting adapter-side holding sections therein.

6. The system as claimed in claim 1, characterized in that at least one of the first contact carrier modules is latched in the module frame, and at least one of the second contact carrier modules in the module frame is fastened thereto by way of the latching elements thereof to two adapter elements, which are situated diametrically opposite one another.

7. The system as claimed in claim 6, characterized in that a first and a second of the mating latching geometries of the first contact carrier modules are in each case formed on the one of the first contact carrier modules, which first and second lateral mating latching geometries are formed from two spring arms which are connected to one another and between which there is a gap for engagement by the latching elements.

8. The system as claimed in claim 6, characterized in that a first and a second of the latching geometries of the second contact carrier modules are in each case formed on the one of the second contact carrier modules which projects out of the respective side wall of the one of the second contact carrier module as a projection.

9. The system as claimed in claim 1, characterized in that the adapter elements comprise a web which is adjoined in an integral manner by a frame part with a window-like opening.

10. The system as claimed in claim 9, characterized in that the adapter elements have holding sections which project laterally from the web and are formed with a triangular cross section.

11. The system as claimed in claim 9, characterized in that the opening is in the form of a T-shaped opening in the respective adapter elements.

12. The system as claimed in claim 9, characterized in that, when one or more of the adapter elements is in the mounted state, the web bears against one of the module frame side walls, whereas the frame part projects at least partially beyond a top side of the module frame side wall.

13. The system as claimed in claim 9, characterized in that, when one or more of the adapter elements is in the mounted state, one or more of the latching elements respectively protrudes into or through a portion of the opening, wherein another portion of the opening remains open, so that one or more of the latching geometries of one or more of the second contact carrier modules can pass through the remaining portion of the opening for fastening said one or more second contact carrier modules.

14. A modular plug connector comprising a plurality of identical and/or different contact modules and a plug connector module frame;

the plug connector module frame having a plurality of latching elements along two module frame side walls for fastening first contact carrier modules thereto, each of the first contact carrier modules has a mating latching geometry which corresponds to the latching elements, and one or more adapter elements configured to be fastened to one of the module frame side walls without using a tool, in order to fasten to said module frame side walls, second contact carrier modules with a latching geometry which is different from the latching elements;

wherein holding elements for fastening the adapter elements are respectively provided on the module frame side walls which run in the longitudinal direction.

15. A system, comprising:

a plug connector module frame having a plurality of latching elements along module frame side walls for fastening first contact carrier modules thereto, each of the first contact carrier modules has a mating latching geometry which corresponds to the latching elements, and one or more adapter elements configured to be fastened to one of the module frame side walls without using a tool, in order to fasten to said module frame side walls, second contact carrier modules with a latching geometry which is different from the latching elements, wherein the adapter elements comprise a web which is adjoined in an integral manner by a frame part with a window-like opening.

16. The system as claimed in claim 15, wherein the adapter elements have holding sections which project laterally from the web and are formed with a triangular cross section.

17. The system as claimed in claim 15, wherein the opening is in the form of a T-shaped opening in the respective adapter elements.

18. The system as claimed in claim 15, wherein when one or more of the adapter elements is in the mounted state, the web bears against one of the module frame side walls, whereas the frame part projects at least partially beyond a top side of the module frame side wall.

19. The system as claimed in claim 15, wherein when one or more of the adapter elements is in the mounted state, one or more of the latching elements respectively protrudes into or through a portion of the opening, wherein another portion of the opening remains open, so that one or more of the latching geometries of one or more of the second contact carrier modules can pass through the remaining portion of the opening for fastening said one or more second contact carrier modules.

20. A system, comprising:

a plug connector module frame having a plurality of latching elements along module frame side walls for fastening first contact carrier modules thereto, each of the first contact carrier modules has a mating latching geometry which corresponds to the latching elements, and one or more adapter elements configured to be fastened to one of the module frame side walls without using a tool, in order to fasten to said module frame side walls, second contact carrier modules with a latching geometry which is different from the latching elements, wherein at least one of the first contact carrier modules is latched in the module frame, and at least one of the second contact carrier modules in the module frame is fastened thereto by way of the latching elements thereof to two adapter elements, which are situated diametrically opposite one another.

21. The system as claimed in claim 20, wherein a first and a second of the mating latching geometries of the first contact carrier modules are in each case formed on the one of the first contact carrier modules, which first and second lateral mating latching geometries are formed from two spring arms which are connected to one another and between which there is a gap for engagement by the latching elements.

22. The system as claimed in claim 20, wherein a first and a second of the latching geometries of the second contact carrier modules are in each case formed on the one of the second contact carrier modules which projects out of the respective side wall of the one of the second contact carrier module as a projection.

* * * * *